US011037494B1

(12) United States Patent
Chang et al.

(10) Patent No.: US 11,037,494 B1
(45) Date of Patent: Jun. 15, 2021

(54) DYNAMIC POWER CONVERTER SWITCHING FOR DISPLAYS

(71) Applicant: Google LLC, Mountain View, CA (US)

(72) Inventors: Sun-il Chang, San Jose, CA (US); Sang Young Youn, Cupertino, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/824,239

(22) Filed: Mar. 19, 2020

(51) Int. Cl.
*G09G 3/3233* (2016.01)

(52) U.S. Cl.
CPC ... *G09G 3/3233* (2013.01); *G09G 2320/0613* (2013.01); *G09G 2320/0626* (2013.01); *G09G 2330/021* (2013.01)

(58) Field of Classification Search
CPC .. G09G 3/3233; G09G 3/3225; G09G 3/3688; G09G 3/3648; G09G 2330/021; G09G 2330/02; G09G 2320/0626; G09G 2320/0285; G09G 2300/0866; G09G 2330/023
See application file for complete search history.

(56) References Cited

U.S. PATENT DOCUMENTS

| | | | | |
|---|---|---|---|---|
| 9,437,127 | B2 | 9/2016 | Park et al. | |
| 10,089,931 | B2 | 10/2018 | Aflatooni et al. | |
| 2009/0109147 | A1* | 4/2009 | Park | G09G 3/3233 345/76 |
| 2016/0125799 | A1* | 5/2016 | Shin | G09G 3/3208 345/212 |
| 2017/0132975 | A1* | 5/2017 | Park | G09G 3/3233 |

* cited by examiner

*Primary Examiner* — Xuemei Zheng
(74) *Attorney, Agent, or Firm* — Shumaker & Sieffert, P.A.

(57) ABSTRACT

An example device includes a plurality of power converters configured to supply electrical power to a display, each optimized for a different output load current range; and a controller configured to: estimate a current level of the display; select, based on the estimated current level, a power converter of the plurality of power converters; and cause electrical power from the selected power converter to be supplied to the display.

20 Claims, 4 Drawing Sheets

DYNAMIC POWER CONVERTER SWITCHING FOR DISPLAYS

BACKGROUND

Display devices may include light emitting elements that generate light using electrical energy. For instance, an organic light emitting diode (OLED) display device may include a matrix of OLEDs that each generate light using electrical energy. The amount of electrical energy consumed by a light emitted element may be related to what is being displayed by the display. For instance, an OLED display may consume more power when displaying a brighter image than when displaying a darker image.

SUMMARY

In general, aspects of this disclosure are directed to systems that include power converters that supply electrical power to a display (e.g., to light emitting elements of the display). A display may consume varying amounts of power based on what is being displayed (e.g., based on the brightness of what is being displayed). Power converters may be designed to operate efficiently (e.g., output power vs. input power) in certain ranges. For instance, a particular power converter may be optimized to supply load currents in a range from 60 milliamps (mA) to 300 mA. When a display supplied by the particular power converter draws an amount of current outside the optimized range, the particular power converter is still able to supply the required power, but with reduced efficiency.

In accordance with one or more techniques of this disclosure, a system may include a plurality of power converters configured to supply electrical power to a display, each optimized for a different output load current range. For instance, a first power converter of the plurality of power converters may be optimized to supply load currents in a first range and a second power converter of the plurality of power converters may be optimized to supply load currents in a second range. A controller of the system may select a power converter of the plurality of power converters to supply power to the display based on an estimated current level to be used by the display at a future time. For instance, responsive to determining that the estimated current level to be used by the display is within the first range, the controller may cause electrical power from the selected power converter to be supplied to the display at the future time. As such, the power converter of the plurality of power converters that can most efficiently supply the amount of power used by the display will be dynamically used. In this way, the techniques of this disclosure enable a reduction in the amount of power used to drive displays.

In one example, a device includes a plurality of power converters configured to supply electrical power to a display, each optimized for a different output load current range; and a controller configured to: estimate a current level of the display; select, based on the estimated current level, a power converter of the plurality of power converters; and cause electrical power from the selected power converter to be supplied to the display.

In another example, a method includes estimating, by a controller of device, a current level of a display of a device; selecting, by the controller and based on the estimated current level, a power converter of a plurality of power converters that are configured to supply electrical power to the display, each of the plurality of power converters being optimized for a different output load current range; and causing, by the controller, electrical power from the selected power converter to be supplied to the display.

In another example, a device includes a plurality of power converters configured to supply electrical power to a display, each optimized for a different output load current range, wherein each power converter of the plurality of power converters includes a respective set of ELVDD and ELVSS power converters; means for estimating a current level of the display; means for selecting, based on the estimated current level, a power converter of the plurality of power converters; and means for causing electrical power from the selected power converter to be supplied to the display.

The details of one or more examples are set forth in the accompanying drawings and the description below. Other features, objects, and advantages of the disclosure will be apparent from the description and drawings, and from the claims.

DETAILED ABSTRACT OF THE INVENTION

Figure 1:
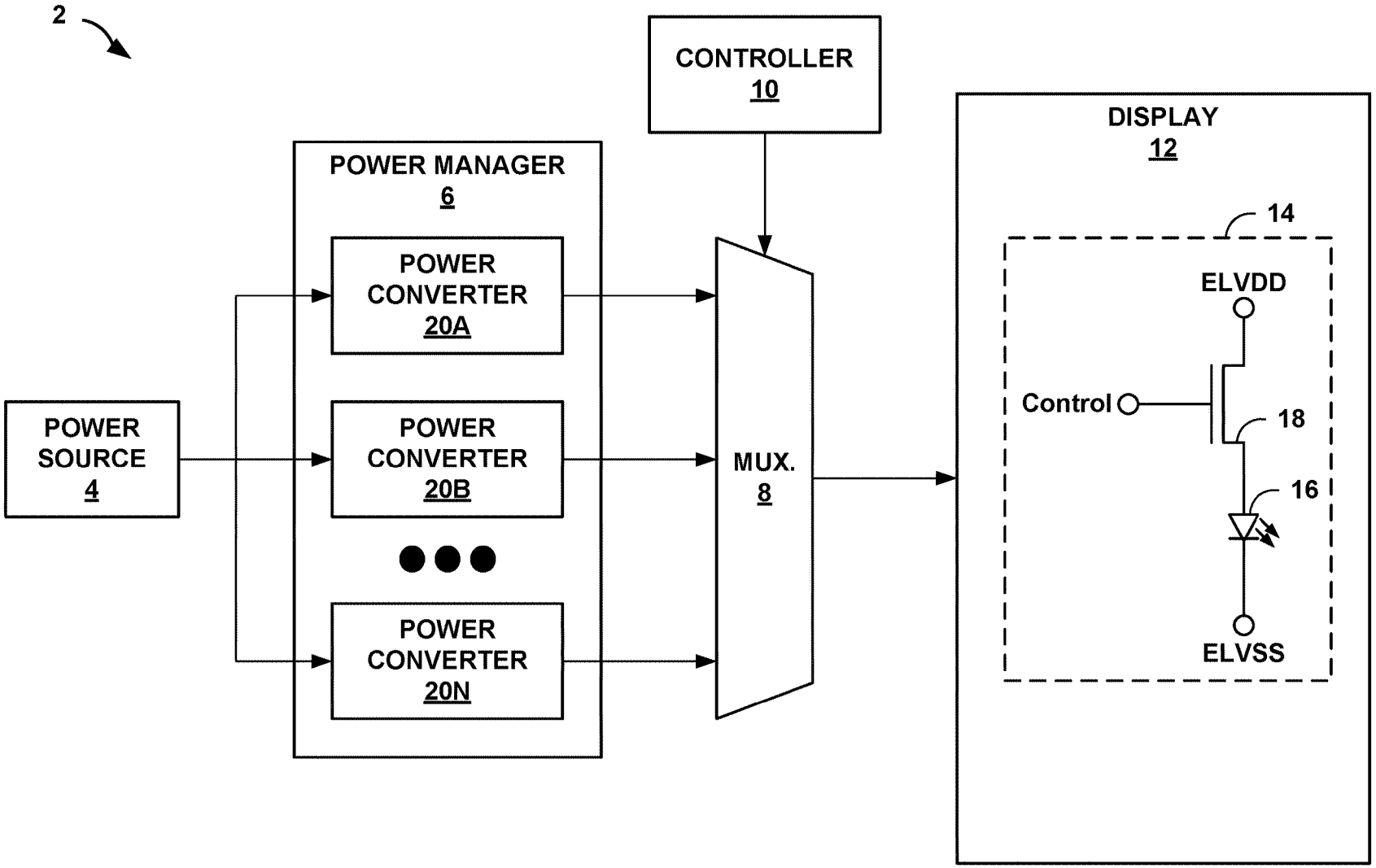
FIG. 1 is a block diagram illustrating a device that includes a plurality of power converters configured to supply electrical power to a display, in accordance with one or more aspects of this disclosure.

FIG. 1 is a block diagram illustrating a device that includes a plurality of power converters configured to supply electrical power to a display, in accordance with one or more aspects of this disclosure. As shown in FIG. 1, device 2, includes, power source 4, power manager 6, multiplexer 8, controller 10, and display 12.

In the example of FIG. 1, device 2 can be any device that includes a display. Examples of device 2 include, but are not limited to, a mobile phone, a camera device, a tablet computer, a smart display, a laptop computer, a desktop computer, a gaming system, a media player, an e-book reader, a television platform, a vehicle infotainment system or head unit, or a wearable computing device (e.g., a computerized watch, a head mounted device such as a VR/AR headset, computerized eyewear, a computerized glove).

Power source 4 may be any component capable of supplying electrical power to other components of device 2. Examples of power source 4 include, but are not limited to, batteries (primary cells, secondary cells, or combinations thereof), photovoltaic panels, mechanical generators, fuel cells, or any other device capable of providing electrical power.

Power manager 6 may include one or more components capable of processing and supplying electrical power for use by other components of device 2, such as display 12. In some examples, power manager 6 may be a plurality of components separately attached to a board (e.g., a printed circuit board) of device 2. In some examples, one or more components of power manager 6 may be included in an integrated circuit, which may be referred to as a power management integrated circuit (PMIC). Power manager 6 may be capable of concurrently supplying at least two power signals (e.g., for use by display 12). For instance, where display 12 is an organic light emitting diode (OLED) display, power manager 6 may include a power converter configured to supply an ELVDD power signal and an ELVSS power signal.

Display 12 may be capable of rendering data into images viewable by a user of device 2. For example, display 12 may include a matrix of pixels that are individually controllable. Examples of display 12 include, but are not limited to, liquid crystal displays (LCD), light emitting diode (LED) displays, organic light-emitting diode (OLED) displays, microLED displays, or similar monochrome or color displays capable of outputting visible information to a user of device 2.

Display 12 may include one or more light emitting elements. The light emitting elements may form a backlight for a display or may form pixels of a display. As one example, where display 12 is an LCD display, display 12 may include one or more light emitting elements arranged as a backlight. As another example, where display 12 is an OLED display or a microLED display, display 12 may include a plurality of light emitting elements individually operating as pixels.

An example circuit of a single light emitting element of display 12 is shown in box 14 of FIG. 1. For simplicity, only a single light emitting element is shown. However, it is understood that display 12. includes a plurality of circuits that perform operations similar to the example circuit shown in box 14. As shown in box 14, light emitting element 16 (e.g., a light emitting diode (LED)) may be coupled to an ELVSS node and switch 18 (e.g., illustrated as a transistor), which is in turn connected to an ELVDD node and controlled by signal Control. The ELVSS node and the ELVDD node may be respectively supplied by the ELVSS and ELVDD power signals generated by power manager 6. The state of switch 18 may be controlled by signal Control (e.g., supplied by a display controller) and may control the amount of current that flows through light emitting element 16. As one example, when switch 18 is off, no current may flow through light emitting element 16 and light emitting element 16 may emit no light. As another example, when switch 18 is on, current may flow through light emitting element 16 and light emitting element 16 may emit light. In addition to being fully on or fully off, switch 18 may operate in one or more intermediate states in which intermediate amounts of current flow though light emitting element 16, thereby enabling brightness control (e.g., dimming) of light emitting element 16.

The amount of power consumed by the light emitting elements of display 12 may vary based on the image being formed by display 12. For instance, light emitting elements of display 12 may consume more power (e.g., a higher current level) when display 12 is displaying a brighter image than when display 12 is displaying a darker image.

As discussed above, power manager 6 may include a power converter configured to supply power signals (e.g., ELVDD and ELVSS) that may be used to drive light emitting elements of display 12. Examples of such a power converter include DC/DC converters such as buck, boost, buck-boost, cuk, flyback, or any other type of DC/DC converter. In one specific example, power manager 6 may include a boost converter configured to generate the ELVDD power signal and a buck-boost converter configured to generate the ELVSS power signal. By their nature, power converters have different efficiencies under different operational conditions (e.g., efficiency may be a function of output current). In general efficiency may be considered to be the amount of power provided by a power converter relative to the amount of power consumed by the power converter. For instance, a power converter that consumes 10 watts (W) of power while outputting 9 W may be considered to be 90% efficient. Values of components of a power converter may influence the efficiency of the power converter and may thus be selected to achieve certain efficiency targets. For instance, the values of inductors and capacitors of the power converter of power manager 6 may be selected to provide optimal efficiency at a normal operating current level of display 12.

However, in some examples, a display, such as display 12, may be operated such that there is no one normal operating current level. For instance, in addition to a normal mode in which images are displayed with normal brightness and display 12 consumes a normal operating current level (e.g., between approximately 50 mA and 200 mA), device 2/display 12 may operate in a dark mode in which images are altered so as to appear darker (e.g., with a lower brightness than the normal mode) and display 12 consumes a reduced operating current level (e.g., between approximately 10 mA and 50 mA), a lock mode in which limited information is displayed (e.g., just the time, date, etc.), and/or any other mode in which the operating current level of display 12 is different than the normal operating current level.

In accordance with one or more aspects of this disclosure, power manager 6 may include a plurality of power converters 20A-20N (collectively, "power converters 20") that are each optimized for a different output load current range. For instance, as opposed to including only a single set of ELVDD/ELVSS power converters, power converters 20 may each include a respective set of ELVDD/ELVSS power converters optimized to supply electrical power to display 12 at a different current range.

In operation, controller 10 may dynamically switch which power converter of power converters 20 is supplying electrical power to display 12. For instance, controller 10 may estimate a current level of display 12 (e.g., an amount of current used by display 12), select, based on the estimated current level, a power converter of power converters 20; and cause electrical power from the selected power converter of power converters 20 to be supplied to display 12. As one example, where display 12 is being operated in the dark mode, controller 10 may cause a first power converter from power converters 20 that is optimized for a lower load range to supply electrical power to display 12. As another example, where display 12 is being operated in the normal mode, controller 10 may cause a second power converter from power converters 20 that is optimized for a higher load range (e.g., than the first power converter) to supply electrical power to display 12.

Figure 2:
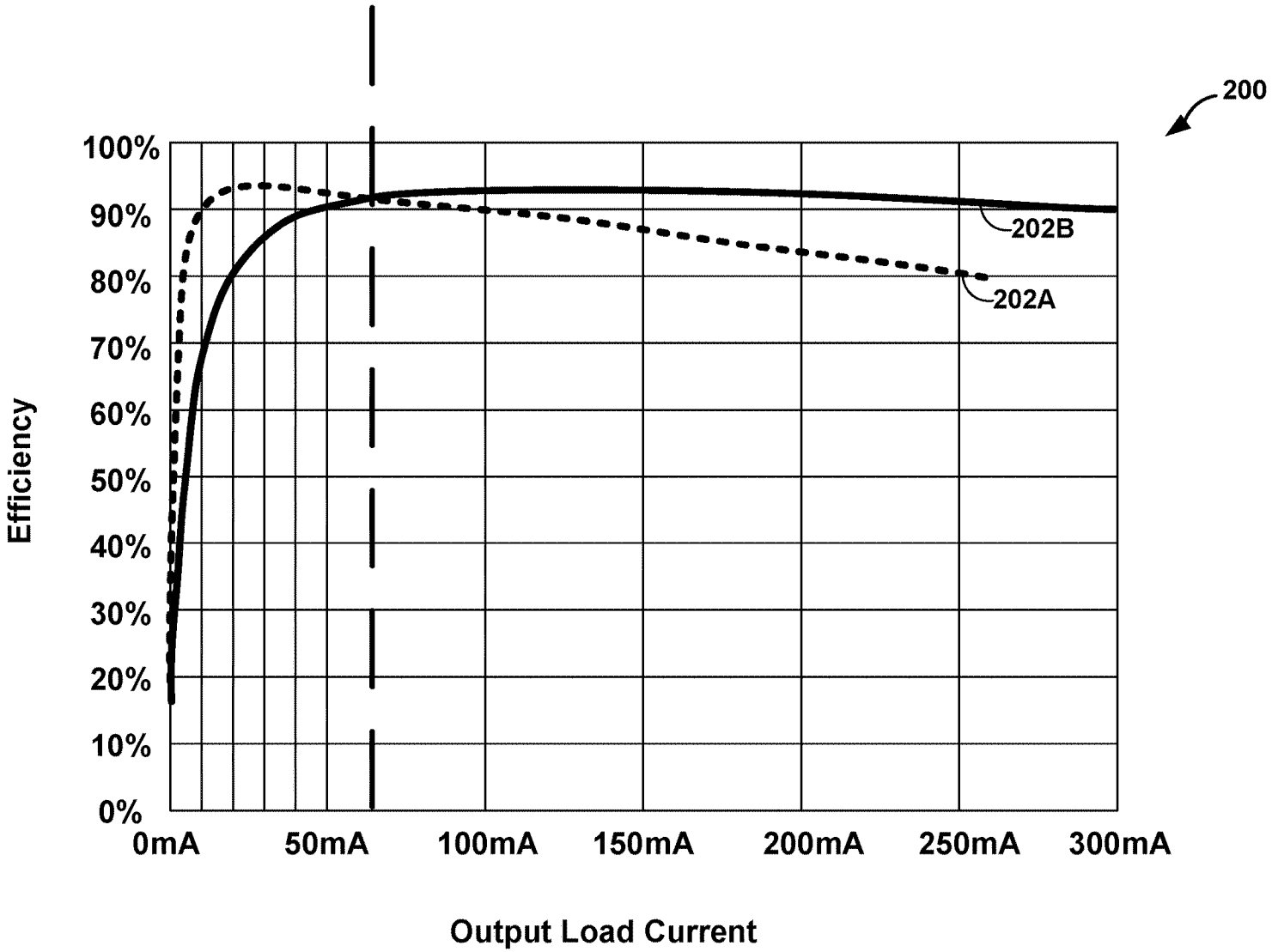
FIG. 2 is a graph illustrating example efficiencies across output load currents for various power converters of power converters, in accordance with one or more aspects of this disclosure.

FIG. 2 is a graph illustrating example efficiencies across output load currents for various power converters of power converters 20, in accordance with one or more aspects of this disclosure. As shown in FIG. 2, graph 200 includes a horizontal axis representing output load current of a power converter, a vertical axis representing efficiency of a power converter, and plots 202A and 202B representing example relationships between efficiency and output load current for various power converters. For instance, plot 202A may represent the relationship between efficiency and output load current for power converter 20A of FIG. 1 and plot 202B may represent the relationship between efficiency and output load current for power converter 20B of FIG. 1.

As can be seen from plots 202A and 202B in FIG. 2, power converters 20A and 20B may be optimized for efficient operation in different load current ranges. For instance, as can be seen from plot 202A, power converter 20A may be optimized for efficient operation from approximately 10 mA to approximately 50 mA. Similarly, as can be seen from plot 202B, power converter 20B may be optimized for efficient operation from approximately 50 mA to approximately 250 mA.

In operation, multiplexer 8 and/or controller 10 may enable dynamic switching between power converters 20. For instance, controller 10 may estimate a current level to be used by display 12 at a future time. As discussed in further detail below, controller 10 may estimate the current level based on one or more of a variety of factors such as a display brightness setting and content to be displayed by display 12. Controller 10 may select, based on the estimated current level, a power converter of power converters 20. For instance, controller 10 may select the power converter of power converters 20 that is optimized to supply electrical power at the estimated current level. Controller 10 may cause electrical power from the selected power converter to be supplied to display 12 at the future time. As one example, where device 2 includes multiplexer 8, controller 10 may cause multiplexer 8 to route ELVDD and ELVSS power signals from the selected power converter to display 12. As another example, (e.g., where multiplexer 8 is omitted and the outputs of all of power converters 20 are connected to common ELVSS and ELVSS nodes, such as shown in FIG. 3), controller 10 may cause the selected power converter of power converters 20 to output the power signals and cause the other power converters to refrain from outputting the power signals.

Controller 10 may be any controller or processor capable of performing the operations described herein. Examples of controller 10 include, but are not limited to, one or more digital signal processors (DSPs), general purpose microprocessors, application specific integrated circuits (ASICs), field programmable logic arrays (FPGAs), systems on a chip (SoC), or other equivalent integrated or discrete logic circuitry.

Figure 3:
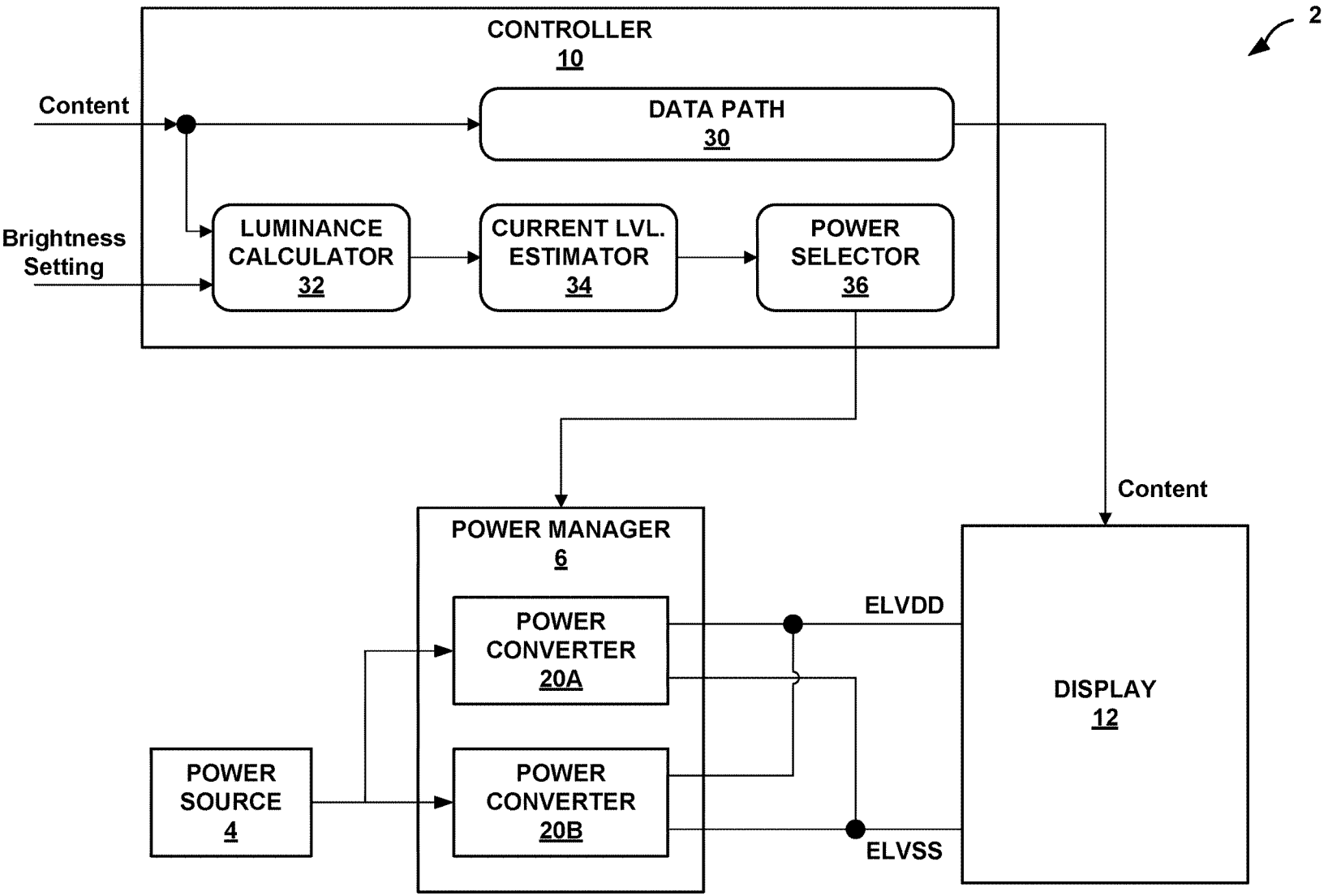
FIG. 3 is a block diagram illustrating details of another example of the device of FIG. 1, in accordance with one or more aspects of this disclosure.

FIG. 3 is a block diagram illustrating details of another example of the device of FIG. 1, in accordance with one or more aspects of this disclosure. As shown in the example FIG. 3 as opposed to FIG. 1, device 2 may omit multiplexer 8 and the outputs of power converters 20 may be connected to common nodes (e.g., an ELVDD node and an ELVSS node) which supply power to display 12. As discussed above, in such examples, controller 10 may dynamically control which power converter of power converters 20 supplies power by only operating the desired power converter and shutting down the other power converters.

As discussed above, controller 10 may enable dynamic switching between power converters 20. For instance, controller 10 may estimate a current level to be used by display 12 at a future time, select, based on the estimated current level, a power converter of power converters 20, and cause electrical power from the selected power converter to be supplied to display 12 at the future time.

As shown in FIG. 3, controller 10 may include data path 30, luminance calculator 32, current level estimator 34, and power selector 36. Controller 10 may receive data from one or more other components of device 2. For instance, controller 10 may receive content and/or brightness settings from a central processing unit (CPU) of device 2. The content may represent what is to be displayed by display 12. For instance, the content may include pixel values that collectively form an image to be displayed by display 12. The brightness settings may indicate a general brightness level for operation of display 12. The brightness settings may be user controlled (e.g., via a slider or some other user interface element) and/or may be automatically controlled by device 2 (e.g., based on ambient light sensed via a light sensor).

Data path 30 may perform one or more actions to process the content before the content is provided to display 12. For instance, data path 30 may include one or more frame buffers that store frames of image data to be shown at display 12.

Luminance calculator 32 may be configured to determine a luminance level of display 12. For instance, luminance calculator 32 may determine a predicted luminance level of display 12 at a future time based on the brightness setting and/or content to be displayed at display 12 at the future time. As one example, based on the brightness setting, an operating mode of display 12 (e.g., dark mode, normal mode, etc.), and/or content to be displayed at display 12 at the future time (e.g., as accessed from a frame buffer), luminance calculator 32 may determine the predicted luminance level of display 12 to be 20 nits (candela per square meter). Luminance calculator 32 may determine the luminance level using any suitable technique. For example, luminance calculator 32 may determine the luminance level by inputting the brightness setting and/or content to be displayed at display 12 into a machine learning model (e.g., trained based on previous iterations on device 2 or similar devices).

Current level estimator 34 may be configured to determine an estimated current level of display 12. For instance, current level estimator 34 may determine the estimated current level of display 12 based on the predicted luminance level determined by luminance calculator 32. As one example, based on the luminance level, current level estimator 34 may determine the estimated current level to be 10 mA. Current level estimator 34 may determine the current level using any suitable technique. For example, current level estimator 34 may determine the current level by inputting the luminance model into a machine learning model (e.g., trained based on previous iterations on device 2 or similar devices).

Power selector 36 may be configured to select a power converter of power converters 20 based on the estimated current level. For instance, power selector 36 may include a look-up table (LUT) that maps between current levels and power converters. An example LUT is shown below in Table 1.

TABLE 1

| Current Range | Power Converter |
|---|---|
| 10 mA-50 mA | Power converter 20A |
| 51 mA-250 mA | Power converter 20B |

As shown above in Table 1, if the estimated current level is between 10 mA and 50 mA, power selector 36 may select power converter 20A. Similarly, if the estimated current level is between 51 mA and 250 mA, power selector 36 may select power converter 20B.

Power selector 36 may cause electrical power from the selected power converter to be supplied to the display at the future time. As one example, as shown in the example of FIG. 3, power selector 36 may cause the selected power converter of power converters 20 to supply electrical power to display 12 while causing the other power converters of power converters 20 to not supply electrical power to display 12. As another example, as shown in the example of FIG. 1, power selector 36 may output a signal to multiplexer 8 that causes power from the selected power converter of power converters 20 to be routed to display 12 (while similarly not operating the other power converters of power converters 20).

As discussed above, in some examples, controller 10 may select from power converters 20 based on a current level estimated to be used by display 12 at a future time. Utilizing a future current estimation in this way may provide several benefits. For instance, by selecting a power converter based on a current level estimated to be used in the future, controller 10 may avoid inducing flickering in display 12 (e.g., that may otherwise be introduced by switching between power converters based on a live/present/instant current level used by display 12).

Controller 10 may be configured to periodically update the selection of a power converter from power converters 20. For instance, controller 10 may be configured to update the selection of the power converter from power converters 20 based on an occurrence of an event. Example events include, but are not limited to, display 12 displaying a particular quantity of frames (e.g., 1, 5, 10, 20, 30, 60, 120, etc.), passage of a particular amount of time (e.g., 1 second, 2 seconds, 5 seconds, 10 seconds, 30 seconds, 1 minute, etc.), and the like. As one example, controller 10 may determine that the event has occurred responsive to determining that a particular quantity of frames has been displayed by display 12 (e.g., based on monitoring of a framebuffer of, or used by, display 12). As another example, controller 10 may determine that the event has occurred responsive to determining that a particular amount of time has passed.

Figure 4:
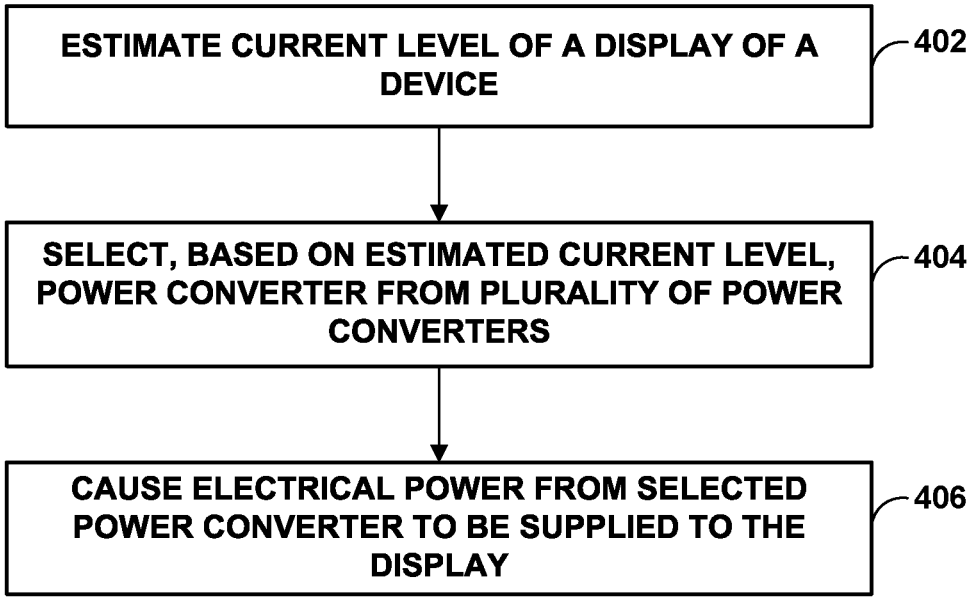
FIG. 4 is a flowchart illustrating example operations of an example controller configured to dynamically select a power converter from a plurality of power converters, in accordance with one or more aspects of the present disclosure.

FIG. 4 is a flowchart illustrating example operations of an example controller configured to dynamically select a power converter from a plurality of power converters, in accordance with one or more aspects of the present disclosure. The operations of controller 10 are described within the context of device 2 of FIG. 1 and FIG. 3.

Controller 10 may estimate a current level of a display of a device (402). For instance, controller 10 may estimate an amount of current to be utilized by display 12 at a future time. As discussed above, controller 10 may estimate the current level based on any number of factors including one or both of a brightness setting of display 12 and content to be displayed by display 12.

Controller 10 may select, based on the estimated current level, a power converter from a plurality of power converters (404). For instance, controller 10 may select a power converter of power converters 20 that operates the most efficiently (e.g., as compared to other power converters of power converters 20) at the estimated current level.

Controller 10 may cause electrical power from the selected power convert to be supplied to the display (406). For instance, where power converters 20 are switched mode power converters, controller 10 may operate the selected power converter and not operate the other power converters of power converters 20. In examples where device 2 includes a multiplexer (e.g., multiplexer 8 of FIG. 1), controller 10 may output a signal that causes the multiplexer to route power from the selected power converter to display 12.

The following numbered examples may illustrate one or more aspects of the disclosure:

Example 1. A device comprising: a plurality of power converters configured to supply electrical power to a display, each optimized for a different output load current range; and a controller configured to: estimate a current level of the display; select, based on the estimated current level, a power converter of the plurality of power converters; and cause electrical power from the selected power converter to be supplied to the display.

Example 2. The device of example 1, wherein the plurality of power converters includes a first power converter optimized for a first output load current range and a second power converter optimized for a second output load current range, and wherein to select the power converter of the plurality of power converters, the controller is configured to: select the first power converter responsive to determining that the estimated current level is within the first output load current range; and select the second power converter responsive to determining that the estimated current level is within the second output load current range.

Example 3. The device of example 1 or 2, wherein each power converter of the plurality of power converters includes a respective set of ELVDD and ELVSS power converters.

Example 4. The device of example 3, wherein the display comprises an organic light emitting diode (OLED) display.

Example 5. The device of any of examples 1-4, wherein, to estimate the current level of the display, the controller is configured to: estimate the current level to be used by the display at a future time, and wherein, to cause electrical power from the selected power converter to be supplied to the display, the controller is configured to: cause electrical power from the selected power converter to be supplied to the display at the future time.

Example 6. The device of example 5, wherein, to estimate the current level to be used by the display at the future time, the controller is configured to: estimate, based on one or more of a brightness setting of the display, an operating mode of the display, and content to be displayed by the display, the current level to be used by the display at the future time.

Example 7. The device of claim 6, wherein the operating mode of the display comprises either a dark mode or a normal mode.

Example 8. The device of any of examples 1-7, wherein the controller is configured to update the selection of the power converter of the plurality of power converters based on an occurrence of an event.

Example 9. The device of example 8, wherein the controller is configured to determine that the event has occurred responsive to determining that a particular quantity of frames has been displayed by the display.

Example 10. The device of example 8 or 9, wherein the controller is configured to determine that the event has occurred responsive to determining that a particular amount of time has passed.

Example 11. A method comprising: estimating, by a controller of device, a current level of a display of a device; selecting, by the controller and based on the estimated current level, a power converter of a plurality of power converters that are configured to supply electrical power to the display, each of the plurality of power converters being optimized for a different output load current range; and causing, by the controller, electrical power from the selected power converter to be supplied to the display.

Example 12. The method of example 11, wherein the plurality of power converters includes a first power converter optimized for a first output load current range and a second power converter optimized for a second output load current range, and selecting the power converter of the plurality of power converters comprises: selecting the first power converter responsive to determining that the estimated current level is within the first output load current range; and selecting the second power converter responsive to determining that the estimated current level is within the second output load current range.

Example 13. The method of example 11 or 12, wherein each power converter of the plurality of power converters includes a respective set of ELVDD and ELVSS power converters.

Example 14. The method of any combination of examples 11-13, wherein estimating the current level of the display comprises: estimating the current level to be used by the display at a future time, and wherein causing electrical power from the selected power converter to be supplied to the display comprises: causing electrical power from the selected power converter to be supplied to the display at the future time.

Example 15. The method of example 14, wherein estimating the current level to be used by the display at the future time comprises: estimating, based on one or more of a brightness setting of the display, an operating mode of the display, and content to be displayed by the display, the current level to be used by the display at the future time.

Example 16. The method of any combination of examples 11-15, further comprising: updating the selection of the power converter of the plurality of power converters based on an occurrence of an event.

Example 17. The method of example 16, further comprising determining that the event has occurred responsive to determining that a particular quantity of frames has been displayed by the display.

Example 18. The method of example 16 or 17, further comprising determining that the event has occurred responsive to determining that a particular amount of time has passed.

Example 19. A device comprising: a plurality of power converters configured to supply electrical power to a display, each optimized for a different output load current range, wherein each power converter of the plurality of power converters includes a respective set of ELVDD and ELVSS power converters; means for estimating a current level of the display; means for selecting, based on the estimated current level, a power converter of the plurality of power converters; and means for causing electrical power from the selected power converter to be supplied to the display.

Example 20. The device of example 19, wherein the means for estimating the current level comprise means for estimating the current level to be used by the display at a future time, and wherein the means for causing the electrical power from the selected power converter to be supplied to the display comprise means for causing electrical power from the selected power converter to be supplied to the display at the future time.

The techniques described in this disclosure may be implemented, at least in part, in hardware, software, firmware, or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Such hardware, software, and firmware may be implemented within the same device or within separate devices to support the various techniques described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware, firmware, or software components. Rather, functionality associated with one or more modules or units may be performed by separate hardware, firmware, or software components, or integrated within common or separate hardware, firmware, or software components.

The techniques described in this disclosure may also be embodied or encoded in an article of manufacture including a computer-readable storage medium encoded with instructions. Instructions embedded or encoded in an article of manufacture including a computer-readable storage medium encoded, may cause one or more programmable processors, or other processors, to implement one or more of the techniques described herein, such as when instructions included or encoded in the computer-readable storage medium are executed by the one or more processors. Computer readable storage media may include random access memory (RAM), read only memory (ROM), programmable read only memory (PROM), erasable programmable read only memory (EPROM), electronically erasable programmable read only memory (EEPROM), flash memory, a hard disk, a compact disc ROM (CD-ROM), a floppy disk, a cassette, magnetic media, optical media, or other computer readable media. In some examples, an article of manufacture may include one or more computer-readable storage media.

In some examples, a computer-readable storage medium may include a non-transitory medium. The term "non-transitory" may indicate that the storage medium is not embodied in a carrier wave or a propagated signal. In certain examples, a non-transitory storage medium may store data that can, over time, change (e.g., in RAM or cache).

Various aspects have been described in this disclosure. These and other aspects are within the scope of the following claims.

The invention claimed is:

1. A device comprising:

a plurality of power converters configured to supply electrical power to a display, each optimized for a different output load current range; and a controller configured to:

estimate a current level of the display;

select, based on the estimated current level, a power converter of the plurality of power converters; and cause electrical power from the selected power converter to be supplied to the display.

2. The device of claim 1, wherein the plurality of power converters includes a first power converter optimized for a first output load current range and a second power converter optimized for a second output load current range, and wherein to select the power converter of the plurality of power converters, the controller is configured to:

select the first power converter responsive to determining that the estimated current level is within the first output load current range; and select the second power converter responsive to determining that the estimated current level is within the second output load current range.

3. The device of claim 1, wherein each power converter of the plurality of power converters includes a respective set of ELVDD and ELVSS power converters.

4. The device of claim 3, wherein the display comprises an organic light emitting diode (OLED) display.

5. The device of claim 1, wherein, to estimate the current level of the display, the controller is configured to:

estimate the current level to be used by the display at a future time, and wherein, to cause electrical power from the selected power converter to be supplied to the display, the controller is configured to:

cause electrical power from the selected power converter to be supplied to the display at the future time.

6. The device of claim 5, wherein, to estimate the current level to be used by the display at the future time, the controller is configured to:

estimate, based on one or more of a brightness setting of the display, an operating mode of the display, and content to be displayed by the display, the current level to be used by the display at the future time.

7. The device of claim 6, wherein the operating mode of the display comprises either a dark mode or a normal mode.

8. The device of claim 1, wherein the controller is configured to update the selection of the power converter of the plurality of power converters based on an occurrence of an event.

9. The device of claim 8, wherein the controller is configured to determine that the event has occurred responsive to determining that a particular quantity of frames has been displayed by the display.

10. The device of claim 8, wherein the controller is configured to determine that the event has occurred responsive to determining that a particular amount of time has passed.

11. A method comprising:

estimating, by a controller of device, a current level of a display of a device;

selecting, by the controller and based on the estimated current level, a power converter of a plurality of power converters that are configured to supply electrical power to the display, each of the plurality of power converters being optimized for a different output load current range; and causing, by the controller, electrical power from the selected power converter to be supplied to the display.

12. The method of claim 11, wherein the plurality of power converters includes a first power converter optimized for a first output load current range and a second power converter optimized for a second output load current range, and selecting the power converter of the plurality of power converters comprises:

selecting the first power converter responsive to determining that the estimated current level is within the first output load current range; and selecting the second power converter responsive to determining that the estimated current level is within the second output load current range.

13. The method of claim 11, wherein each power converter of the plurality of power converters includes a respective set of ELVDD and ELVSS power converters.

14. The method of claim 11, wherein estimating the current level of the display comprises:

estimating the current level to be used by the display at a future time, and wherein causing electrical power from the selected power converter to be supplied to the display comprises:

causing electrical power from the selected power converter to be supplied to the display at the future time.

15. The method of claim 14, wherein estimating the current level to be used by the display at the future time comprises:

estimating, based on one or more of a brightness setting of the display, an operating mode of the display, and content to be displayed by the display, the current level to be used by the display at the future time.

16. The method of claim 11, further comprising:

updating the selection of the power converter of the plurality of power converters based on an occurrence of an event.

17. The method of claim 16, further comprising determining that the event has occurred responsive to determining that a particular quantity of frames has been displayed by the display.

18. The method of claim 16, further comprising determining that the event has occurred responsive to determining that a particular amount of time has passed.

19. A device comprising:

a plurality of power converters configured to supply electrical power to a display, each optimized for a different output load current range, wherein each power converter of the plurality of power converters includes a respective set of ELVDD and ELVSS power converters;

means for estimating a current level of the display;

means for selecting, based on the estimated current level, a power converter of the plurality of power converters; and means for causing electrical power from the selected power converter to be supplied to the display.

20. The device of claim 19, wherein the means for estimating the current level comprise means for estimating the current level to be used by the display at a future time, and wherein the means for causing the electrical power from the selected power converter to be supplied to the display comprise means for causing electrical power from the selected power converter to be supplied to the display at the future time.

* * * * *